United States Patent [19]

Grenier

[11] Patent Number: 4,658,472

[45] Date of Patent: Apr. 21, 1987

[54] MOUNTABLE STRAP TYPE HINGE WITHOUT RIGID ARTICULATION AXIS

[75] Inventor: Jean Grenier, Pantin, France

[73] Assignee: Louis Vuitton, SA, Paris, France

[21] Appl. No.: 892,470

[22] Filed: Aug. 5, 1986

Related U.S. Application Data

[63] Continuation of Ser. No. 776,991, Sep. 16, 1985, abandoned, which is a continuation of Ser. No. 531,910, Sep. 12, 1983, abandoned.

[30] Foreign Application Priority Data

Sep. 14, 1982 [FR] France ..... 82 15485

[51] Int. Cl.[4] ..... E05D 1/00

[52] U.S. Cl. ..... 16/225

[58] Field of Search ..... 16/225, 226, 388, DIG. 13

[56] References Cited

U.S. PATENT DOCUMENTS

| | | | |
|---|---|---|---|
| 1,963,941 | 6/1934 | Duffy | 16/225 X |
| 2,241,101 | 5/1941 | Teeter | 16/225 X |
| 2,253,606 | 8/1941 | Boltz | 16/225 |
| 2,607,411 | 8/1952 | Van Vliet | 16/225 X |
| 3,048,806 | 8/1962 | Heidler | 16/225 X |
| 3,054,608 | 9/1962 | Pava | 16/225 X |
| 3,385,422 | 5/1968 | Lowry | 16/225 X |
| 4,024,605 | 5/1977 | Henke | 16/225 X |
| 4,451,097 | 5/1984 | Wohlford | 16/225 X |

FOREIGN PATENT DOCUMENTS

| | | | |
|---|---|---|---|
| 2106356 | 8/1971 | Fed. Rep. of Germany | 16/225 |
| 2901371 | 7/1980 | Fed. Rep. of Germany . | |
| 2078613 | 11/1971 | France . | |
| 439076 | 12/1967 | Switzerland | 16/225 |

*Primary Examiner*—Fred Silverberg

*Attorney, Agent, or Firm*—Merchant, Gould, Smith, Edell, Welter & Schmidt

[57] ABSTRACT

The hinge of the strap type is made as a connecting mechanism between the parts to be secured to the elements to be connected together. The strap comprises the cylindric selvedges each of which cooperates with at least one groove formed in at least a portion of a double part in form of a jaw and made integral with each of the elements to be assembled together, a central band in the strap having minimum width to permit free rotation of such elements relative to one another.

1 Claim, 5 Drawing Figures

MOUNTABLE STRAP TYPE HINGE WITHOUT RIGID ARTICULATION AXIS

This is a continuation of application Ser. No. 776,991, filed on Sept. 16, 1985, now abandoned which is a continuation of application Ser. No. 531,910, filed Sept. 12, 1983, now abandoned.

TECHNICAL FIELD

This invention relates to an improved hinge without any rigid articulation axis.

BACKGROUND

The Applicant has already realized such hinges by means of a strap having a significant edge width along selvedges entirely embedded into a plastic material. This implies that the hinge was previously manufactured and supplied so as to be ready for the mounting thereof.

SUMMARY OF THE INVENTION

The object of this invention is now a hinge of this type with a strap substantially characterized in that the strap comprises two cylindric selvedges and that each of such selvedges is designed for cooperation with at least one grooved formed in at least a portion of a double part in form of a jaw made integral with each of the elements to be assembled, a central band of such strap being of a minimum width to permit free rotation of those elements relative to one another.

According to other characteristics:

- both parts of the double part in form of a jaw belong to the hinge proper and are removable;
- according to a modified form of embodiment, a portion of the assembly in form of a jaw is a constituent removable element of the hinge, the other portion belonging to the element to be assembled to which said hinge element is secured;
- each of the portions of the hinge is formed with a groove for housing the corresponding cylindric selvedge of the strap;
- additional means is provided for acting upon the central band and producing a folding area thereby resulting in an imaginary rotational centerline;
- the strap is of a supple and/or elastic material selected among the types of materials including leathers, imitation leathers, woven or unwoven textiles, with natural or synthetic fibers, and a portion or all of which can be elastic, and the like materials;
- the cylindric selvedges consist of small compact rolls either of the same material as that of the strap or of a different material, such rolls being always more rigid than the strap proper;
- in a variation the cylindric selvedges are tubular made of a material identical or different from that of the strap, the inside of each tube being filled with a stem of any rigid material such as metallic rod, natural or synthetic rush, and the like.

Other characteristics and advantages of this invention will appear more clearly from the following description which is made with reference to the attached drawings in which:

DETAILED DESCRIPTION OF INVENTION

Figure 1:
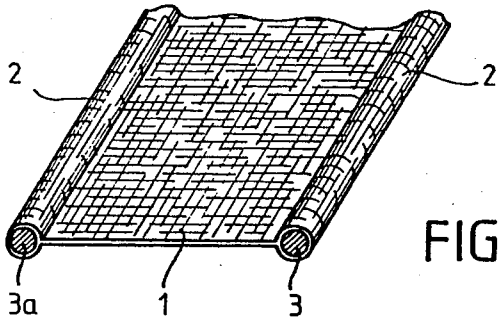
FIG. 1 is a perspective view of a strap for realization of a hinge according to the invention and FIGS. 2 to 5 are sectional end views of a possible form of embodiment of a hinge according to the invention, in four different positions respectively, i.e. with an opening angle of 0°, of 45°, of 90° and of 180°.
Figure 2:
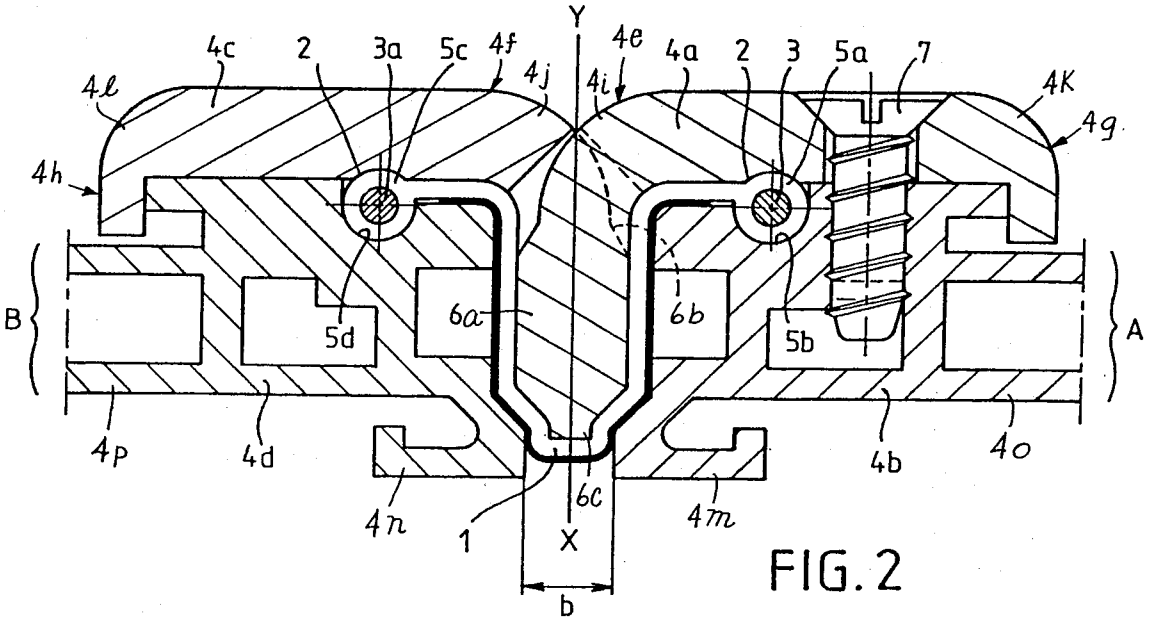

With reference to the attached drawings the strap used for realizing a hinge according to the invention is substantially constituted by a band 1 of a suitable supple and/or elastic material of a width that may vary from about 1 cm to about 10 cm, or more, (depending on the size of the hinge to be manufactured). Each selvedge of such band consists of a compact or tubular roll 2 produced by any known means which is made integral with said strap or is added thereto. Anyhow, said rolls are more rigid than the strap itself. In case of tubular rolls these are in forms of sheaths for stems or rushes 3-3*a* of any appropriate materials such as metallic rods or natural or synthetic rushes.

Starting from such a specific strap, a hinge according to the invention is realized in the following way (see FIGS. 2 to 5):

The selvedges 2 are inserted and somehow sandwiched between two parts in form of jaws such as those at 4*a*-4*b* 4*c*-4*d*, each of said parts being formed with a respective groove 5*a*-5*b*, 5*c*-5*d*, as well as suitable means for holding each jaw assembly in a tightened position on either side and all along each selvedge roll. Such jaw assemblies can be realized so as to be dismountable or not, the particular realization thereof being left to the man of the art. Such jaw assemblies are designed so as to leave a central area of minimum width b therebetween, upon mounting the hinge, to permit them to play freely and to easily rotate one relative to the other about an imaginary centerline represented by the symmetrical axis x-y of the assembly. For better functioning thereof and to avoid untimely foldings in the strap in such central area, there is provided on at least one of the jaw assemblies a curved member (such as at 6) directed to the central area of the strap and resting thereon so as to form a single folding which coincides with said imaginary centerline. The so realized hinge can be secured mechanically by any appropriate means and to the elements to be assembled together through the assemblies mounted on the selvedges.

In the form of embodiment shown in an illustrative manner in the attached drawings, the rolls 2 are tubular and are used as sheaths for rigid stems 3-3*a* and the parts 4*b* and 4*d* of each jaw are made integral with each element to be assembled (A-B) so that it is sufficient for mounting a hinge according to the invention to form respective first and second grooves 5*b* and 5*d* in such elements and to provide means (such as the screw 7) for clamping the rolls 3-3*a* therebetween. Also in this case, each part 4*a*-4*c* comprises its own curved member 6; to prevent two such members from being disposed on opposite to the other, and thus impair the operation of the hinge, they are advantageously provided in an alternate arrangement.

Referring to FIGS. 2–5, first double part jaw 4*a*-4*b* includes a first inner end 4*e*, a first outer end 4*g*, a first portion 4*a* and a second portion 4*b*. The first portion 4*a* includes an inner segment 4*i* and outer segment 4*k*. The second portion 4*b* includes an inner segment 4*m* and outer segment 4*o*. A first element (A) can be affixed to the first jaw 4*a*-4*b* at the outer end 4*g* thereof. More particularly, in the preferred embodiment shown a first element (A) can be affixed to and extend outwardly away from the outer segment 4o of the second portion 4b. A first curved member 6a projects perpendicular from the first portion 4a at the inner segment 4i and extends substantially along and spaced from the inner segment 4m of the second portion 4b. The curved member 6a includes a free end 6c which is directed to and rests on the central area of the strap 1. The second double part jaw 4c–4d includes a second inner end 4f, a second outer end 4h, a third portion 4c and a fourth portion 4d. The third portion 4c includes an inner segment 4j and an outer segment 41. The fourth portion 4d includes an inner segment 4n and outer segment 4p. A second element (B) can be affixed to the second jaw 4c–4d at the outer end 4h thereof. More particularly, in the preferred embodiment shown the second element (B) can be affixed to and extend outwardly away from the outer end 4p of the fourth portion 4d. A second curved member 6b projects perpendicular from the third portion 4c at the inner segment 4j and extends substantially along and spaced from the inner segment 4n of the fourth portion 4d. The curved member 6b includes a free end 6d which is directed to and rests on the central area of the strap 1. The first and second curved members 6a, 6b are in alternating arrangement along the longitudinal folding axis of the strap 1.

Figure 3:
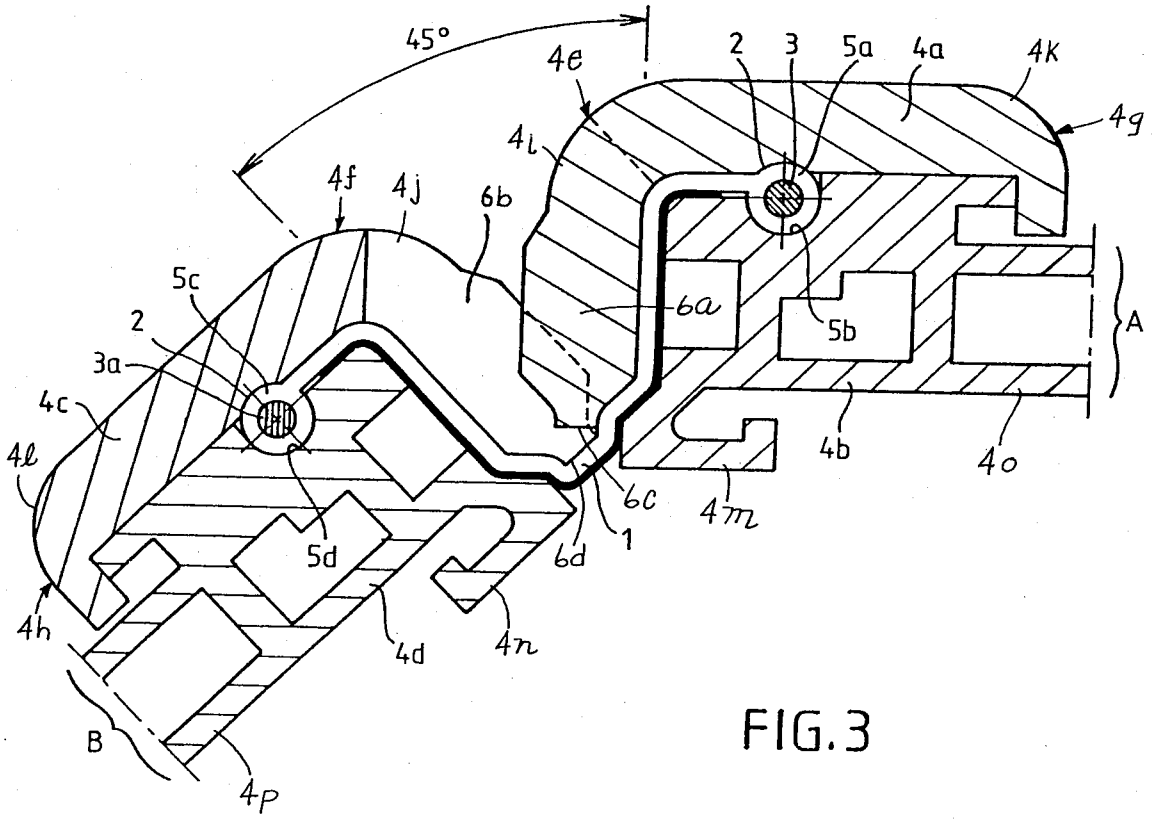
Figure 4:
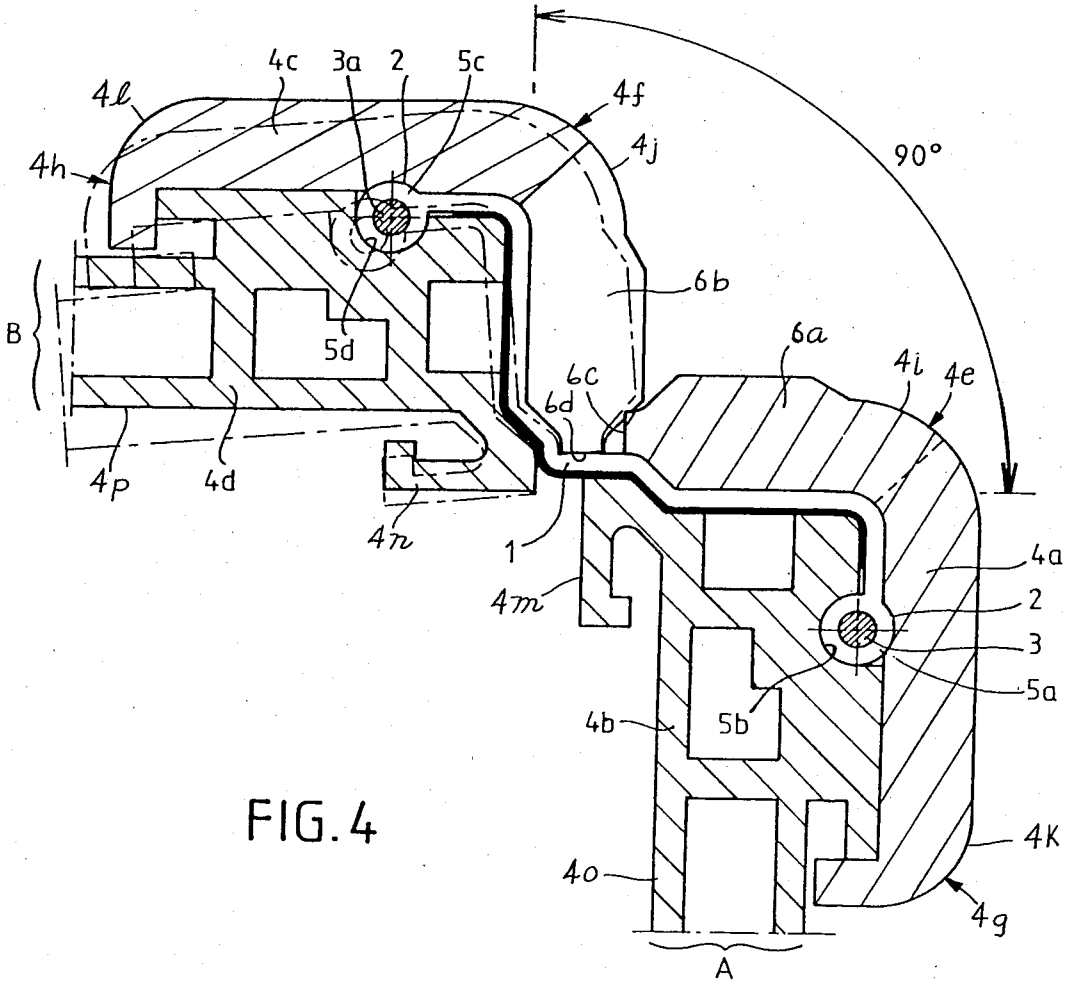
Figure 5:
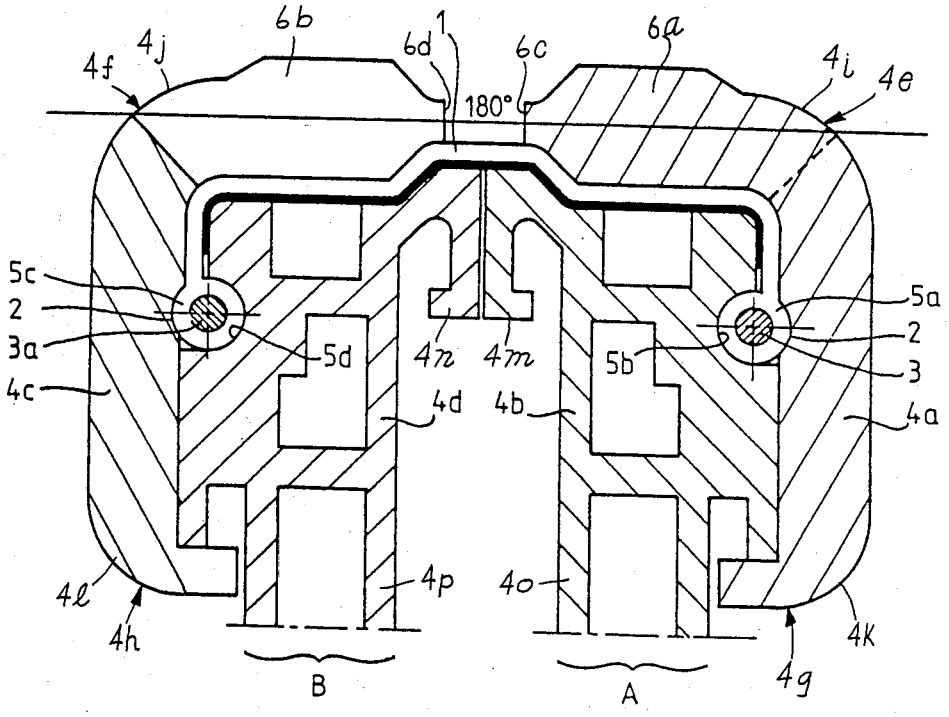

Examination of FIGS. 2 to 5 shows that a hinge according to the invention provides for an opening angle of from 0° (FIG. 2) to 180° (FIG. 5), with FIGS. 3 and 4 showing the respective intermediary opening angles (45° and 90°). Particularly with respect to the folding action performed by the curved members 6a, 6b, in a first position (FIG. 5) the first and second curved members 6a, 6b are in substantially lateral alignment with each other. In a second position (FIG. 2), the first and second curved members 6a, 6b are in substantially longitudinal alignment with the first and second free ends 6c, 6d directed to the central area of the strap 1 and resting thereon, thereby forming a single folding which conicides with the longitudinal rotational centerline of the central band of the strap 1.

It will be noted that the hinge according to the invention can be easily manufactured and mounted since all the constituents thereof are dismountable and exchangeable.

Finally, it will be understood that this invention was only described and represented in a purely explanatory and not at all limitative manner and that any useful modifications can be effected therein without however departing from its scope as defined in the appended claims.

I claim:

1. An improved hinge without rigid articulation axis of the type comprising:

(a) first and a second double part jaws, said first jaw having a first inner end, a first outer end, a first portion including an inner and an outer segment and a second portion including an inner and an outer segment, said first jaw including a first groove formed in at least one of said first and second portions, said first portion having at least one first curved member projecting perpendicular from said first portion at the inner segment thereof, said first curved member extending substantially along and spaced from said inner segment of said second portion and including a free end, said first jaw to be secured to a first element extending outwardly from said first outer end in a latitudinal plane therewith, said second jaw having a second inner end, a second outer end, a third portion including an inner and an outer segment and a fourth portion including an inner and an outer segment, said second jaw including a second groove in at least one of said third and fourth portions, said third portion having at least one second curved member projecting perpendicular from said third portion at said inner segment thereof, said second curve member extending substantially along and spaced from said inner segment of said fourth portion and including a second free end, said second jaw to be secured to a second element extending outwardly from said first outer end in a latitudinal plane therewith, said second curved member being in alternating arrangement with said first curved member, said first and second jaws being hingedly connected to each other at said inner ends thereof;

(b) connection means for connecting said jaws, including a supple strap having first and second cylindric selvedges and a central band including a longitudinal rotational center line along said central band, said first selvedge cooperatively engaging said first groove and said second selvedge cooperatively engaging said second groove, engagement of said selvedges making said supple strap integral with said first and second elements, said central band having a minimum width to permit free rotation of said first and second elements relative to each other, said first and second jaws being hingedly connected by said strap so that in a first position said first and second curved members are in substantially lateral alignment with each other and in a second position said first and second curved members are in substantially longitudinal alignment with said first and second free ends directed to the central area of the strap and resting thereon, thereby forming a single folding which coincides wth said longitudinal rotational center line of said central band; and (c) means for producing a folding area along said central line of said central band, said means acting upon said central band, said means for providing said folding area including said first and second curved members.

* * * * *